US009153245B2

(12) United States Patent
Qi et al.

(10) Patent No.: US 9,153,245 B2
(45) Date of Patent: Oct. 6, 2015

(54) PITCH DETECTION METHOD AND APPARATUS

(75) Inventors: Fengyan Qi, Shenzhen (CN); Dejun Zhang, Shenzhen (CN); Lei Miao, Shenzhen (CN); Jianfeng Xu, Shenzhen (CN); Qing Zhang, Shenzhen (CN); Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 785 days.

(21) Appl. No.: 12/798,715

(22) Filed: Apr. 9, 2010

(65) Prior Publication Data

US 2010/0211384 A1 Aug. 19, 2010

Related U.S. Application Data

(63) Continuation of application No. PCT/CN2009/070423, filed on Feb. 13, 2009.

(51) Int. Cl.
*G10L 25/90* (2013.01)
*G10L 19/09* (2013.01)

(52) U.S. Cl.
CPC ..... *G10L 25/90* (2013.01); *G10L 19/09* (2013.01)

(58) Field of Classification Search
CPC ..... G10L 25/90; G10L 19/09; G10L 19/097; G10L 19/04; G10L 19/08; G10L 21/013; G10L 19/02; G10L 19/032; G10L 19/06; G10L 19/10; G10L 25/24; G10L 25/27; G10L 25/93
USPC ..... 704/217, 218, 205–208, 219, 222, 225, 704/226, 261, 264, 268
See application file for complete search history.

(56) References Cited

U.S. PATENT DOCUMENTS

| | | | | | |
|---|---|---|---|---|---|
| 4,561,102 | A * | 12/1985 | Prezas | ..... | 704/207 |
| 5,717,829 | A * | 2/1998 | Takagi | ..... | 704/503 |
| 5,781,880 | A * | 7/1998 | Su | ..... | 704/207 |
| 5,884,010 | A * | 3/1999 | Chen et al. | ..... | 704/228 |
| 5,999,897 | A | 12/1999 | Yeldener | | |
| 6,243,672 | B1 | 6/2001 | Iijima et al. | | |
| 6,871,176 | B2 * | 3/2005 | Choi et al. | ..... | 704/223 |
| 6,931,373 | B1 * | 8/2005 | Bhaskar et al. | ..... | 704/230 |
| 6,954,726 | B2 * | 10/2005 | Brandel et al. | ..... | 704/217 |

(Continued)

FOREIGN PATENT DOCUMENTS

| | | | |
|---|---|---|---|
| CN | 1412742 | A | 4/2003 |
| CN | 101030374 | A | 9/2007 |
| CN | 101030375 | A | 9/2007 |
| CN | 101325631 | A | 12/2008 |
| EP | 1 587 061 | A1 | 10/2005 |

OTHER PUBLICATIONS

Written Opinion of the International Searching Authority dated Nov. 19, 2009 in connection with International Patent Application No. PCT/CN2009/070423.

(Continued)

*Primary Examiner* — Abdelali Serrou

(57) ABSTRACT

A pitch detection method and apparatus are disclosed. The method includes: performing pitch detection on an input signal in a signal domain, and obtaining a candidate pitch; performing linear prediction (LP) on the input signal, and obtaining an LP residual signal; setting a candidate pitch range that includes the candidate pitch; searching the candidate pitch range for the LP residual signal, and obtaining a selected pitch.

15 Claims, 4 Drawing Sheets

(56) References Cited

U.S. PATENT DOCUMENTS

| | | | | |
|---|---|---|---|---|
| 6,996,523 | B1 * | 2/2006 | Bhaskar et al. | 704/222 |
| 7,013,269 | B1 * | 3/2006 | Bhaskar et al. | 704/219 |
| 7,155,386 | B2 | 12/2006 | Gao | |
| 2003/0074192 | A1 * | 4/2003 | Choi et al. | 704/219 |
| 2003/0149560 | A1 * | 8/2003 | Chen | 704/207 |
| 2003/0171917 | A1 * | 9/2003 | Zhu et al. | 704/207 |
| 2003/0177001 | A1 * | 9/2003 | Chen | 704/207 |
| 2003/0177002 | A1 * | 9/2003 | Chen | 704/207 |
| 2004/0002856 | A1 * | 1/2004 | Bhaskar et al. | 704/219 |
| 2004/0013245 | A1 * | 1/2004 | Yokoyama | 379/88.1 |
| 2004/0181397 | A1 * | 9/2004 | Gao | 704/207 |
| 2005/0021325 | A1 * | 1/2005 | Seo et al. | 704/207 |
| 2008/0253552 | A1 * | 10/2008 | Riera-Palou et al. | 379/406.01 |
| 2008/0270124 | A1 * | 10/2008 | Son et al. | 704/205 |
| 2009/0299736 | A1 * | 12/2009 | Sato | 704/207 |
| 2010/0049510 | A1 | 2/2010 | Zhan et al. | |
| 2010/0063827 | A1 * | 3/2010 | Gao | 704/500 |
| 2010/0174535 | A1 * | 7/2010 | Vos et al. | 704/207 |

OTHER PUBLICATIONS

Office Action dated Jun. 30, 2011 in connection with Chinese Patent Application No. 200980000112.4.

"A G711 Lossless Compression Algorithm Proposal", Cisco Systems, Inc., Telecommunication Standardization Sector, Oct. 8-12, 2007, 21 pages.

Rongshan Yu, et al., "MPEG-4 Scalable to Lossless Audio Coding", Audio Engineering Society, Convention Paper 6183, Oct. 28-31, 2004, 14 pages.

Tilman Liebchen, et al., "MPEG-4 Audio Lossless Coding", Audio Engineering Society, Convention Paper 6047, May 8-11, 2004, 9 pages.

"G711 Lossless Compression Algorithm: Market Need, Use Cases and Design Requirements", Cisco Systems, Inc., Telecommunication Standardization Sector, Oct. 8-12, 2007, 7 pages.

International Search Report dated Nov. 19, 2009 in connection with International Patent Application No. PCT/CN2009/070423.

* cited by examiner

PITCH DETECTION METHOD AND APPARATUS

CROSS-REFERENCE TO RELATED APPLICATION

This application is a continuation of and claims priority to International Application No. PCT/CN2009/070423, filed on Feb. 13, 2009, which is hereby incorporated by reference in its entirety.

FIELD OF THE INVENTION

The present invention relates to a speech and audio signal encoding technology, and in particular, to a pitch detection method and apparatus.

BACKGROUND OF THE INVENTION

To save bandwidths for transmitting and storing speech and audio signals, the speech and audio encoding technology has been widely used. The technology includes lossy encoding and lossless encoding. For lossy encoding, the reconstructed signal may not keep the same as the original signal, but the signal redundancy information may be minimized according to the features of the sound source and the human auditory perception, little coding information is transmitted and high speech and audio quality is achieved. For lossless encoding, the reconstructed signal may be the same as the original signal, so that the final decoding quality is not degraded. Generally, the lossy encoding compression efficiency is high, but the quality of the reconstructed speech and audio signal cannot be guaranteed. Lossless encoding can guarantee the speech quality because it can reconstruct signals without distortion, but the compression rate is only about 50%.

The pitch is an important parameter either in lossy encoding or lossless encoding. The final encoding performance depends on the accuracy of the pitch detection. In the prior art, a lot of pitch detection methods are available, one of which includes: mapping a signal to a domain, performing search pre-processing, performing coarse search on an open loop basis, and then performing refined search on a closed loop basis, and finally performing post-processing such as pitch smoothing. All these operations are performed in one domain, for example, time domain, frequency domain, cepstrum domain, signal domain, or residual domain.

During the implementation of the present invention, the inventor finds the prior art has the following problems: A lot of operations need be performed in different domains in the actual algorithm, and the pitch detection algorithm shows different levels of performance and complexity in different domains. For example, in the time domain, the pitch detection complexity is low; in the frequency domain, the pitch detection accuracy is higher; in the signal domain, the pitch is better, and is easy to detect; in the residual domain, the pitch is poor, and thus is difficult to detect.

SUMMARY OF THE INVENTION

Embodiments of the present invention provide a pitch detection method and apparatus to overcome the weakness of detecting a pitch in a single domain in the prior art.

To achieve the above objective, embodiments of the present invention provide the following technical solution:

A pitch detection method includes:

performing a pitch detection on an input signal in a signal domain, and obtaining a candidate pitch;

performing a linear prediction (LP) on the input signal, and obtaining an LP residual signal;

setting a candidate pitch range that includes the candidate pitch; and searching for the LP residual signal in the candidate pitch range, and obtaining a selected pitch.

A pitch detection apparatus includes:

a signal-domain pitch detecting unit, configured to perform pitch detection on the input signal in the signal domain, and obtain a candidate pitch;

a linear predicting unit, configured to perform LP on the input signal and obtain an LP residual signal;

a setting unit, configured to set a candidate pitch range that includes the candidate pitch; and a residual-domain refined detecting unit, configured to search for the LP residual signal in the candidate pitch range, and obtain a selected pitch.

The method and apparatus provided in some embodiments of the present invention detect pitches with different accuracy in the signal and residual domains in sequence according to different features of the signal in the two domains. This overcomes the weakness in the prior art. Thus, the complexity of the algorithm is reduced and the accuracy of the pitch detection is guaranteed.

BRIEF DESCRIPTION OF THE DRAWINGS

The accompanying drawings are intended to make the present invention clearer and are part of this application, without constituting any limitation on the present invention: In the accompanying drawings.

DETAILED DESCRIPTION OF THE INVENTION

For better understanding of the objective, technical solution and merits of the invention, embodiments of the present invention are hereinafter described in detail with reference to the accompanying drawings. Embodiments of the present invention and explanations thereof are intended to make the present invention clearer, and the present invention is not limited to such embodiments.

Embodiment 1

This embodiment provides a pitch detection method, which is hereinafter described in detail with reference to the accompanying drawings.

Figure 1:
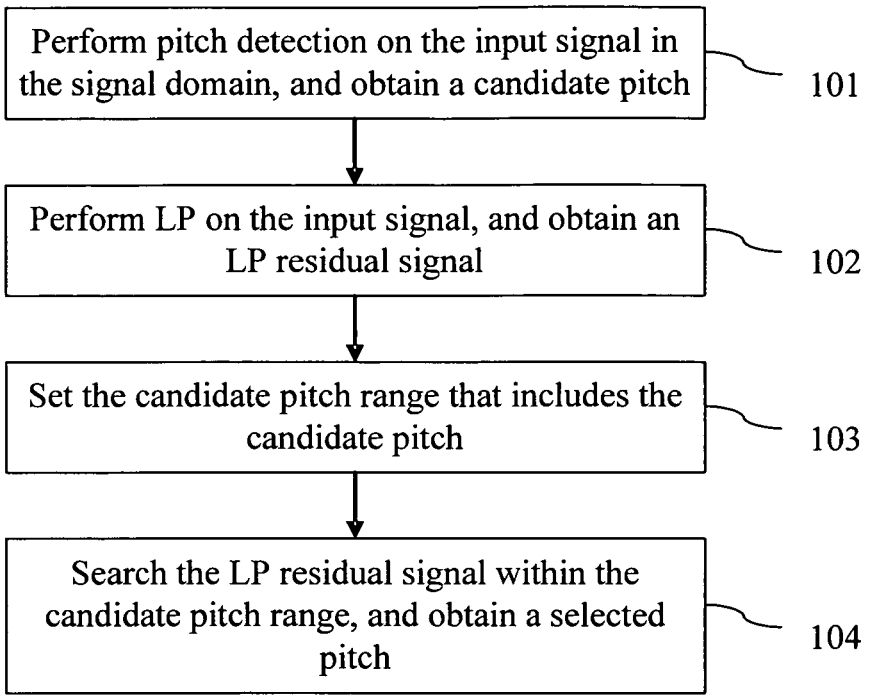
FIG. 1 is a flowchart of a method according to an embodiment of the present invention.

FIG. 1 is a flowchart of a method according to one embodiment of the present invention. As shown in FIG. 1, the pitch detection method includes the following steps:

Block 101: Perform pitch detection on the input signal in the signal domain, and obtain a candidate pitch.

In this embodiment, some pre-processing operations may be performed on the input signal prior to the pitch detection in the signal domain, for example, low pass filtering, median clipping and down sampling; then pitch search is performed on the pre-processed signal. Thus, before block 101, the method may further include pre-processing the input signal and obtaining a pre-processed signal. The process of pre-processing may include: performing low pass filtering and down sampling on the input signal, and obtaining a down sampled signal. In this case, the down sampled signal is provided as the pre-processed signal according to one embodiment, and then the pitch detection is performed on the down sampled signal in the signal domain.

In this embodiment, a lot of signal domain pitch search methods may be available to search the pre-processed signal for the pitch. To guarantee the accuracy and continuity of the pitch, the searched pitch needs to undergo post-processing algorithms such as pitch smoothing and double frequency detection. The pitch detected in the signal domain is used as the candidate pitch for refined detection in the residual domain.

Block 102: Perform a linear prediction on the input signal, and obtain a linear prediction residual signal.

According to one embodiment, the LP residual signal may be obtained by performing linear prediction on the input signal after windowing the input signal.

Block 103: Set a candidate pitch range that includes the candidate pitch.

A lot of encoders transfer the signal to the LP residual domain for processing, these encoders need to obtain an accurate pitch according to the LP residual signal. Thus, a refined pitch needs to be searched refinedly near the candidate pitch on the residual signal to meet the requirements of the encoders.

The minimum value of the candidate pitch range is equal to the difference between the candidate pitch and a first threshold, and the maximum value of the candidate pitch range is equal to the sum of the candidate pitch and a second threshold. The first threshold and the second threshold may be determined according to the performance and complexity of the algorithm. The first threshold may be the same as or different from the second threshold.

Block 104: Search for the LP residual signal refinedly in the candidate pitch range, and obtain a selected pitch.

In this embodiment, the LP residual signal is searched refinedly based on an auto correlation function. A pitch within the candidate pitch range that enables the auto correlation function to be the largest is used as the selected pitch. The LP residual signal may also be searched by comparing the energy of the long-term prediction (LTP) residual signal. The minimum value of the energy of the LTP residual signal is selected within the candidate pitch range; a pitch corresponding to the minimum value of the energy of the LTP residual signal is used as the selected pitch (T').

According to this embodiment, the pitch obtained through the refined search needs to undergo post-processing operations such as pitch smoothing and double frequency detection according to actual conditions, and an optimal pitch that is found through the refined detection in the residual domain is used as the selected pitch.

The method provided in this embodiment detects pitch with different accuracy in the signal and residual domains in sequence according to different features of the signal in the two domains. This overcomes the weakness of pitch detection in a single domain. Thus, the complexity of the algorithm is reduced and the accuracy of the pitch detection is guaranteed.

Embodiment 2

This embodiment provides another pitch detection method, which is hereinafter described in detail with reference to the accompanying drawings.

Figure 2:
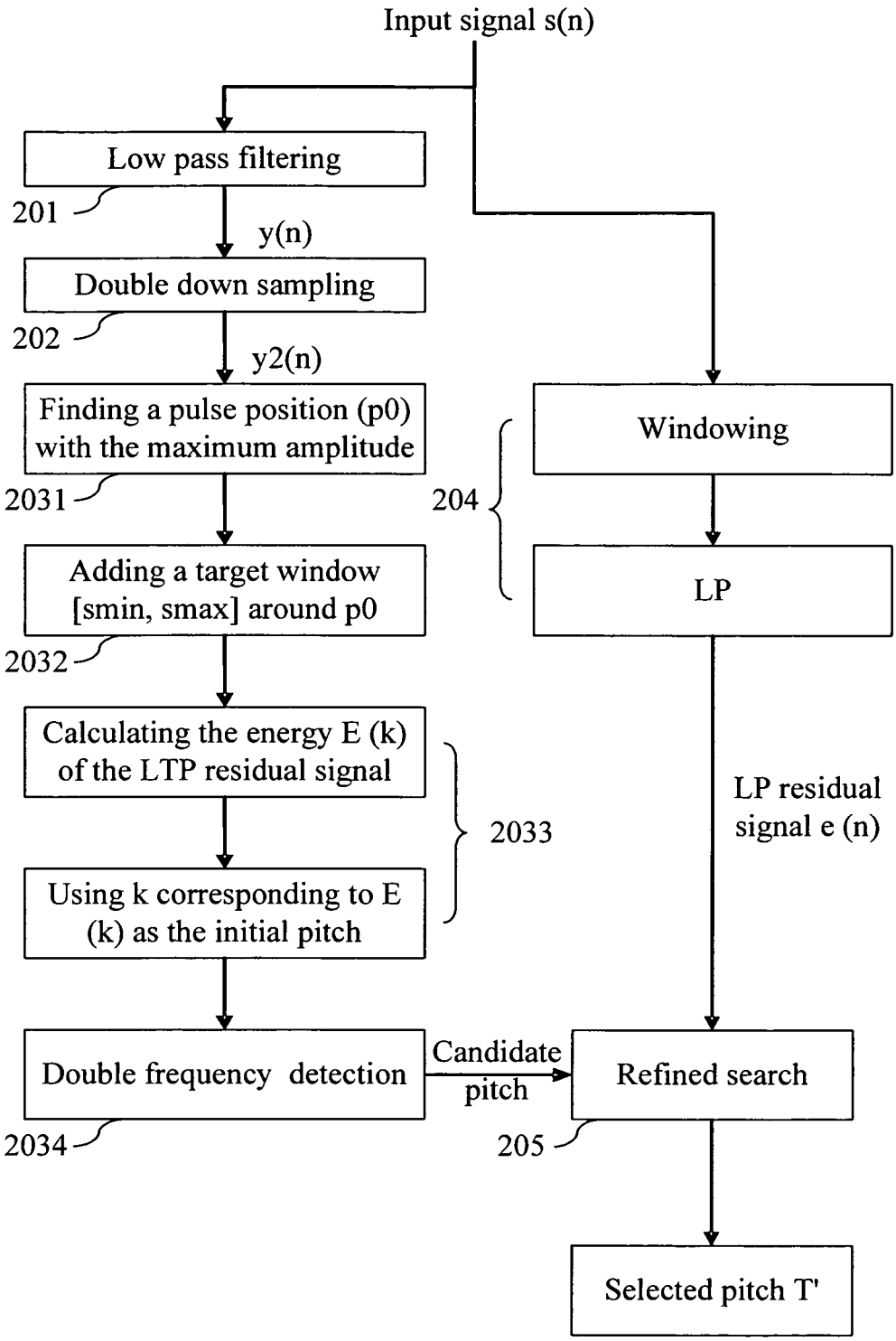
FIG. 2 is a flowchart of method according to another embodiment of the present invention.

FIG. 2 is a flowchart of a method according to another embodiment of the present invention. The method takes the frame length (L) of 160 samples as an example. As shown in FIG. 2, the method includes the following steps:

Block 201: Perform low pass filtering on the input signal s(n), and obtain a low pass filtered signal y(n):

$$y(n) = \frac{s(n) + y(n-1)}{2},$$

where n=0, 1, . . . , L

Block 202: The low pass filtered signal y(n) is down-sampled, and obtain a downsampled signal y2($n$):

$$y2(n)=y(2n), \text{ where}$$

$$n = 0, 1, \ldots, \left(\frac{L}{2} - 1\right).$$

Block 203: Pitch search is performed for the downsampled signal y2($n$).

Because the pitch generally ranges from 2 ms to 20 ms, the pitch range is limited to [20, 83] (8 kHz sampling) in this embodiment and the pitch parameter may be encoded with 6-bit in consideration of encoding efficiency and performance. In addition, the pitch cannot be too long for the frame length of 160 samples; otherwise, few samples in a frame signal participate in the LTP calculation, which may reduce the LTP performance.

Figure 3:
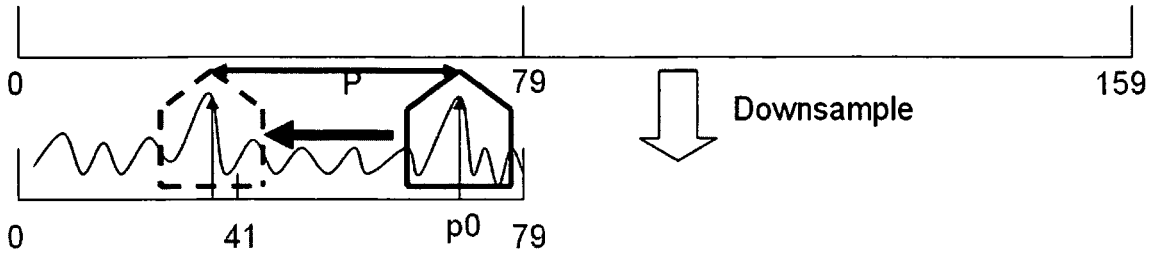
FIG. 3 is a schematic diagram illustrating the pitch search according to an embodiment of the present invention.

In one embodiment, assume that L is equal to 160 samples. In the down sampled signal domain, the pitch range is changed to [10, 41], that is, $P_{MIN}$=10 and $P_{MAX}$=41, as shown in FIG. 3.

In one embodiment, step 203 may further include:

Block 2031: According to the pitch range, find a pulse with the maximum amplitude in the second half-frame signal of the down sampled signal in the down sampled signal domain, where the pulse position is recorded as p0.

$$p0 = \left\{p0 > \text{abs}(y2(n)),\ n \in \left[P_{MAX}, \frac{L}{2} - 1\right],\ n \neq p0\right\}.$$

Block 2032: Add a target window with the size of [smin, smax] around p0, where:

$$s\text{min} = \text{s_max}(p0 - K, 42),$$

$$s\text{max} = \text{s_min}\left(p0 + K, \frac{L}{2} - 1\right), \quad K \in \left[0, \frac{L}{2} - 42\right],$$

and the window length (len) is equal to the difference between smax and smin, where s_max( ) denotes returning a maximum value in the included elements; and s_min( ) denotes returning a minimum value in the included elements.

Block 2033: Obtain an initial pitch according to the pre-processed signal in the target window and sliding windows of the target window.

In this embodiment, the method for obtaining the initial pitch includes but is not limited to the following three methods:

First Method

Calculate the energy E(k) of the LTP residual signal $x_k(i)$, and use the pitch corresponding to the minimum energy as the initial pitch:

$$x_k(i)=y2(i)-g\cdot y2(i-k), i=smin, \ldots, smax,$$

where g indicates an LTP gain factor and k∈[10,41].

Then, $$E(k)=\sum_{i=smin}^{smax} x_k(i)\cdot x_k(i),$$

where k∈[10,41].

Select the minimum value in E(k) and the pitch corresponding to the minimum value as follows:

$$P=\{E(P)<E(k), k\in[10,41], k\neq P\}.$$

Second Method

Match the signals around the pulse with the maximum amplitude in the down sampled signal, obtain the correlation coefficients by calculating the following correlation function, and use the pitch corresponding to the maximum correlation coefficient as the initial pitch.

The correlation function may be $$\mathrm{corr}[k]=\sum_{i=smin}^{smax-1} y2(i)*y2(i-k),$$

where k∈[10,41]. The k value corresponding to the maximum correlation coefficient (corr [.]) is used as the initial pitch (P).

Third Method

Calculate the sum of absolute values of the LTP residual signal $x_k(i)$, and use the pitch corresponding to the minimum sum of absolute values as the initial pitch:

$$x_k(i)=y2(i)-g\cdot y2(i-k), i=smin, \ldots, smax,$$

where g indicates an LTP gain factor and k∈[10,41].

$$E(k)=\sum_{i=smin}^{smax} \mathrm{abs}(x_k(i)),$$

where k∈[10, 41].

Select the minimum value in E(k) and the pitch corresponding to the minimum value as follows:

$$P=\{E(P)>E(k), k\in[10,41], k\neq P\}.$$

Block 2034: To avoid mistaking the double value of the initial pitch as the initial pitch, compare the initial pitch with a pitch twice the initial pitch as follows according to one embodiment:

$$\mathrm{nor_cor}[p]=\frac{\sum_{i=p}^{L-1} y(i)*y(i-p)}{\sum_{i=p}^{L-1} y(i-p)*y(i-p)},$$

where L indicates the frame length and p is equal to P and 2P.

The p in the preceding two pitches (P and 2P) that enable nor_cor[.] to be the largest is used as the candidate pitch, which may be set to T in this embodiment.

Block 204: Window the input signal, perform LP on the input signal, and obtain an LP residual signal e(n).

Block 205: The refined pitch search is performed for the LP residual signal e(n) in the range of $[T-T_{d1}, T+T_{d2}]$, and obtain the selected pitch.

In one embodiment, the pitch may be searched out by using an auto correlation function. Considering the encoding efficiency and performance, the auto correlation function may be represented as one of the following three formulas:

$$\mathrm{nor_cor}[k]=\frac{\sum_{n=k}^{L-1} e(n)*e(n-k)}{\sum_{n=k}^{L-1} e(n-k)*e(n-k)}, k\in[T-T_{d1}, T+T_{d2}]; \quad (1)$$

$$\mathrm{nor_cor}[k]=\frac{\sum_{n=k}^{L-1} e(n)*e(n-k)}{\sqrt{\sum_{n=k}^{L-1} e(n-k)*e(n-k)}}, k\in[T-T_{d1}, T+T_{d2}]; \quad (2)$$

$$\mathrm{nor_cor}[k]=\sum_{n=k}^{L-1} e(n)*e(n-k), k\in[T-T_{d1}, T+T_{d2}]. \quad (3)$$

The k value within the range of $[T-T_{d1}, T+T_{d2}]$ that enables nor_cor[.] to be the largest is used as the optimal pitch (T'), that is, the selected pitch. The first threshold ($T_{d1}$) and the second threshold ($T_{d2}$) may be determined according to the performance and complexity of the algorithm. For example, both $T_{d1}$ and $T_{d2}$ may be set to 2.

In another embodiment, the pitch may be searched out by comparing the energy of the LTP residual signal as follows:

$$u_k(n)=e(n)-g'\cdot e(n-k), i=k, \ldots, L-1,$$

where $u_k(n)$ indicates the LTP residual signal, g' indicates the LTP gain factor and $k\in[T-T_{d1}, T+T_{d2}]$.

$$E(k)=\sum_{i=k}^{L-1} u_k(n)\cdot u_k(n),$$

$k\in[T-T_{d1}, T+T_{d2}]$. Alternatively, E(k) may also be represented by the sum of absolute values of $u_k(n)$.

The minimum value in E(k) is selected and a pitch corresponding to the minimum value is used as the selected pitch (T').

In this embodiment, according to different features of the signal in different domains and requirements of the actual algorithm, a pitch is searched coarsely in the signal domain and then a refined pitch search is performed in the residual domain according to the pitch obtained in the coarse search. The method provided in this embodiment detects pitches with different accuracy in the signal and residual domains in sequence according to different features of the signal in the two domains. This overcomes the weakness in the prior art. Thus, the complexity of the algorithm is reduced and the accuracy of the pitch detection is guaranteed.

Embodiment 3

This embodiment provides a pitch detection apparatus, which is hereinafter described in detail with reference to the accompanying drawing.

Figure 4:
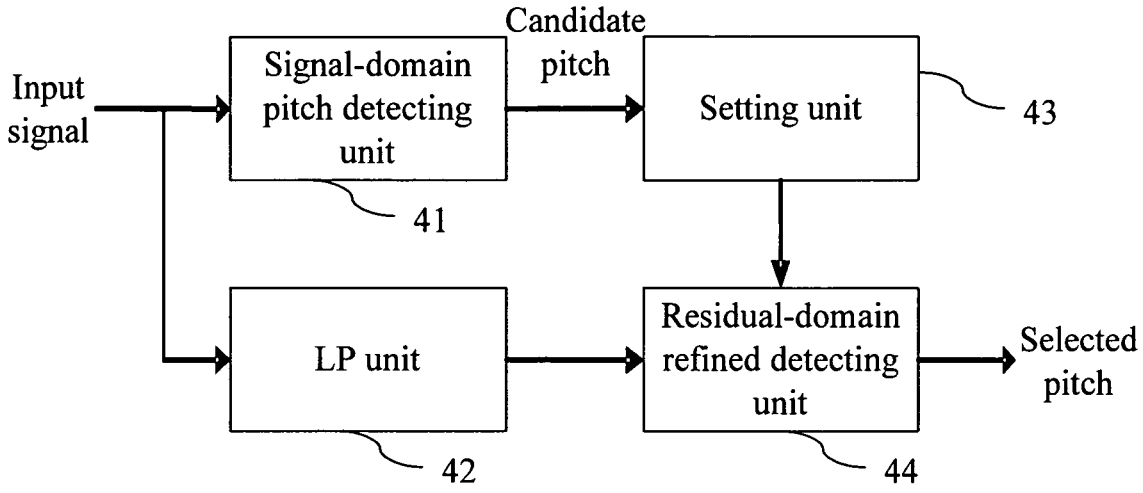
FIG. 4 is a block diagram illustrating components of an apparatus according to an embodiment of the present invention.

FIG. 4 is a block diagram illustrating components of the apparatus according to one embodiment of the present invention. As shown in FIG. 4, the pitch detection apparatus includes:

a signal-domain pitch detecting unit 41, configured to detect the pitch of the input signal in the signal domain, and obtain a candidate pitch;

a linear predicting unit 42, configured to perform LP on the input signal, and obtain an LP residual signal;

a setting unit 43, configured to set a candidate pitch range that includes the candidate pitch; and a residual-domain refined detecting unit 44, configured to search for the LP residual signal refinedly within the candidate pitch range, and obtain a selected pitch.

The components of the apparatus provided in this embodiment are configured to implement each step of the method in the Embodiment 1 of the present invention. Because each step of the method has been described in detail in the first embodiment, these components will not be further described.

The apparatus provided in this embodiment detects pitches with different accuracy in the signal and residual domains in sequence according to different features of the signal in the two domains. This overcomes the weakness in the prior art. Thus, the complexity of the algorithm is reduced and the accuracy of the pitch detection is guaranteed.

Embodiment 4

This embodiment provides a pitch detection apparatus, which is hereinafter described in detail with reference to the accompanying drawing.

Figure 5:
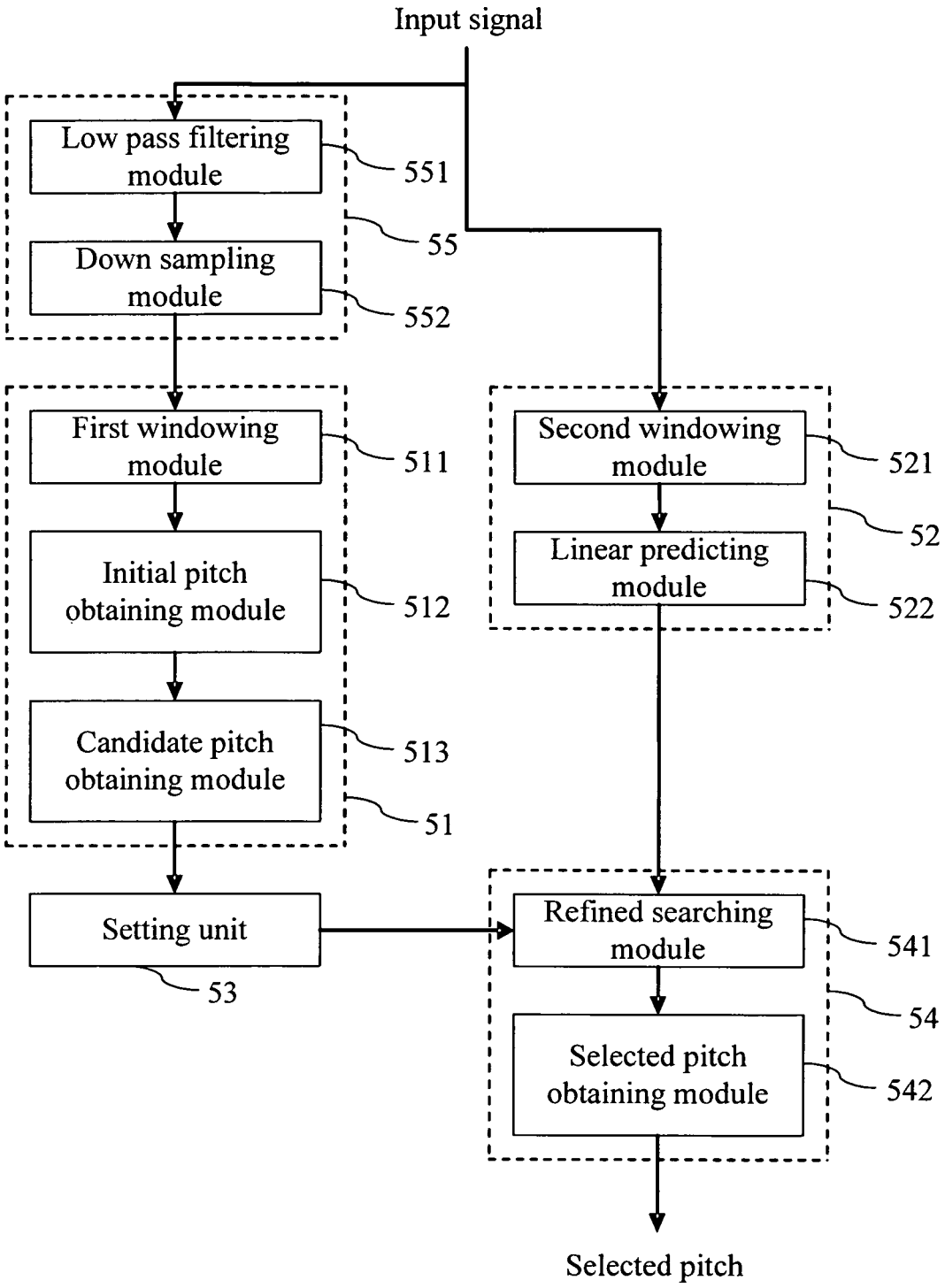
FIG. 5 is a block diagram illustrating components of an apparatus according to another embodiment of the present invention.

FIG. 5 is a block diagram illustrating an apparatus according to another embodiment of the present invention. In this embodiment, the pitch detection apparatus includes a signal-domain pitch detecting unit 51, a linear predicting unit 52, a setting unit 53, a residual-domain refined detecting unit 54, and a pre-processing unit 55, configured to pre-process the input signal, obtain a pre-processed signal, and provide the pre-processed signal to the signal-domain pitch detecting unit 51 in the signal domain.

The pre-processing unit 55 may include:

a low pass filtering module 551, configured to perform low pass filtering on the input signal; and a down sampling module 552, configured to down sample the input signal that has undergone the low pass filtering by the low pass filtering module 551, and obtain a down sampled signal.

In one embodiment, the signal domain pitch detecting unit 51 may include:

a first windowing module 511, configured to add a target window around a pulse position with the maximum amplitude in the second half-frame signal of the pre-processed signal;

an initial pitch obtaining module 512, configured to obtain an initial pitch according to the pre-processed signal in the target window and sliding windows of the target window; and a candidate pitch obtaining module 513, configured to perform double frequency detection on the initial pitch, and obtain a candidate pitch.

The initial pitch obtaining module 512 may be configured to calculate the energy of the LTP residual signal according to the pre-processed signal in the target window and sliding windows of the target window, and use a pitch corresponding to the minimum energy as the initial pitch; or match the signal around a pulse with the maximum amplitude in the pre-processed signal, calculate a correlation coefficient, and use a pitch corresponding to the maximum correlation coefficient as the initial pitch; or calculate the sum of absolute values of the LTP residual signal according to the pre-processed signal in the target window and sliding windows of the target window, and use a pitch corresponding to the minimum sum of absolute values as the initial pitch.

In one embodiment, the linear predicting unit 52 may include:

a second windowing module 521, configured to window the input signal; and a linear predicting module 522, configured to perform LP on the input signal windowed by the windowing module 521, and obtain an LP residual signal.

In one embodiment, the residual-domain refined detecting unit 54 may include:

a refined searching module 541, configured to search for the LP residual signal refinedly by using an auto correlation function or comparing the energy of the LTP residual signal; and a selected pitch obtaining module 542, configured to use a pitch that enables the auto correlation function to be the largest or the energy of the LTP residual signal to be the smallest within the candidate pitch range as the selected pitch.

The components of the apparatus provided in this embodiment are configured to implement each step of the method in the second embodiment of the present invention. Because each step of the method has been described in detail in the second embodiment, these components will not be further described.

The apparatus provided in this embodiment detects pitches with different accuracy in the signal and residual domains in sequence according to different features of the signal in the two domains. This overcomes the weakness in the prior art. Thus, the complexity of the algorithm is reduced and the accuracy of the pitch detection is guaranteed.

Detailed above are the objective, technical solution and merits of the present invention. Although the present invention has been described through several exemplary embodiments and accompanying drawings, the invention is not limited to such embodiments. It is apparent that those skilled in the art can make various modifications and variations to the invention without departing from the spirit and scope of the invention. The invention shall cover the modifications and variations provided that they fall in the scope of protection defined by the following claims or their equivalents.

What is claimed is:

1. A pitch detection method, comprising:

performing a pitch detection on an input signal in a signal domain, and obtaining a candidate pitch;

performing a linear prediction (LP) on the input signal, and obtaining an LP residual signal;

setting a candidate pitch range including the candidate pitch; and performing a pitch detection on the LP residual signal within the candidate pitch range, and obtaining a selected pitch;

wherein before performing the pitch detection on the input signal in the signal domain and obtaining the candidate pitch, the method further comprises:

pre-processing the input signal and obtaining a pre-processed signal;

wherein performing the pitch detection on the input signal in the signal domain and obtaining the candidate pitch comprises:

adding a target window around a pulse with a maximum amplitude in a second half-frame of the pre-processed signal;

obtaining an initial pitch according to the pre-processed signal in the target window and sliding windows of the target window; and detecting double frequency of the initial pitch, and obtaining a candidate pitch;

wherein obtaining the initial pitch according to the pre-processed signals in the target window and sliding windows of the target window comprises:

calculating a sum of absolute values of a long-term prediction (LTP) residual signal, according to the pre-processed signals in the target window and sliding windows of the target window, and using the pitch corresponding to a minimum sum of absolute values as the initial pitch.

2. The method according to claim 1, wherein obtaining the initial pitch according to the pre-processed signals in the target window and sliding windows of the target window comprises:

calculating an energy of the long-term prediction (LTP) residual signal according to the pre-processed signals in the target window and sliding windows of the target window, and using the pitch corresponding to a minimum energy as the initial pitch.

3. The method according to claim 1, wherein obtaining the initial pitch according to the pre-processed signals in the target window and sliding windows of the target window comprises:

according to the pre-processed signals in the target window and sliding windows of the target window, matching the signals around the pulse with the maximum amplitude in a down sampled signal, calculating a correlation function to obtain correlation coefficients, and using the pitch corresponding to a maximum correlation coefficient as the initial pitch.

4. The method according to claim 1, wherein a minimum value of the candidate pitch range is equal to a difference between the candidate pitch and a first threshold, and a maximum value of the candidate pitch range is equal to a sum of the candidate pitch and a second threshold, the first threshold may be the same as or different from the second threshold.

5. The method according to claim 4, wherein performing the pitch detection on the LP residual signal within the candidate pitch range, and obtaining the selected pitch comprises:

performing a pitch search on the LP residual signal by using an auto correlation function; and setting a pitch within the candidate pitch range that enables the auto correlation function to be the largest as the selected pitch.

6. The method according to claim 5, wherein the auto correlation function is:

$$\text{nor_cor}[k] = \frac{\sum_{n=k}^{L-1} e(n) * e(n-k)}{\sum_{n=k}^{L-1} e(n-k) * e(n-k)}, \text{ or}$$

-continued $$\text{nor_cor}[k] = \frac{\sum_{n=k}^{L-1} e(n) * e(n-k)}{\sum_{n=k}^{L-1} e(n-k) * e(n-k)}, \text{ or}$$

$$\text{nor_cor}[k] = \sum_{n=k}^{L-1} e(n) * e(n-k),$$

wherein L indicates the frame length, $k \in [T-T_{d1}, T+T_{d2}]$, T indicates the candidate pitch, $T_{d1}$ indicates the first threshold, and $T_{d2}$ indicates the second threshold, e(n) indicates the LP residual signal.

7. The method according to claim 4, wherein performing the pitch detection on the LP residual signal within the candidate pitch range, and obtaining the selected pitch comprises:

performing a pitch search on the LP residual signal by comparing an energy of the long-term prediction (LTP) residual signal; and setting a pitch within the candidate pitch range that corresponds to a minimum value of the energy of the LTP residual signal as the selected pitch.

8. The method according to claim 1, wherein pre-processing the input signal and obtaining the pre-processed signal comprises: performing low pass filtering and down sampling on the input signal, and obtaining a down sampled signal.

9. A pitch detection apparatus in an audio encoder, the pitch detection apparatus comprising:

a signal-domain pitch detecting unit, configured to detect a pitch of an input signal in a signal domain, and obtain a candidate pitch;

a linear predicting unit, configured to perform linear prediction (LP) on the input signal, and obtain an LP residual signal;

a setting unit, configured to set a candidate pitch range that includes the candidate pitch;

a residual-domain refined detecting unit, configured to perform a pitch detection on the LP residual signal within the candidate pitch range, and obtain a selected pitch;

wherein at least one of the signal-domain pitch detecting unit, the linear predicting unit, the setting unit or the residual-domain refined detecting unit comprises hardware;

wherein the signal domain pitch detecting unit comprises:

a windowing module, configured to add a target window around a pulse position with a maximum amplitude in a second half-frame signal of the pre-processed signal;

an initial pitch obtaining module, configured to obtain an initial pitch according to the pre-processed signal in the target window and sliding windows of the target window; and a candidate pitch obtaining module, configured to perform double frequency detection on the initial pitch, and obtain a candidate pitch;

wherein the initial pitch obtaining module is configured to calculate a sum of absolute values of a long-term prediction (LTP) residual signal according to the pre-processed signal in the target window and sliding windows of the target window, and use a pitch corresponding to a minimum sum of absolute values as the initial pitch.

10. The apparatus according to claim 9, further comprising:

a pre-processing unit, configured to pre-process the input signal, obtain a pre-processed signal, and provide the pre-processed signal to the signal-domain pitch detecting unit in the signal domain.

11. The apparatus according to claim 10, wherein the pre-processing unit comprises:

a low pass filtering module, configured to perform low pass filtering on the input signal; and a down sampling module, configured to down sample the input signal that has undergone the low pass filtering by the low pass filtering module, and obtain a down sampled signal.

12. The apparatus according to claim 9, wherein the initial pitch obtaining module is configured to calculate an energy of the long-term prediction (LTP) residual signal according to the pre-processed signal in the target window and sliding windows of the target window, and use a pitch corresponding to the minimum energy as the initial pitch.

13. The apparatus according to claim 9, wherein the initial pitch obtaining module is configured to match the signal around a pulse with the maximum amplitude in the pre-processed signal, calculate correlation coefficients, and use a pitch corresponding to the largest correlation coefficient as the initial pitch.

14. The apparatus according to claim 9, wherein the linear predicting unit comprises:

a windowing module, configured to window the input signal; and a linear predicting module, configured to perform LP on the input signal windowed by the windowing module, and obtain an LP residual signal.

15. The apparatus according to claim 9, wherein the linear predicting unit comprises:

a refined searching module, configured to search for the LP residual signal refined by using an auto correlation function or comparing the energy of the LTP residual signal; and a selected pitch obtaining module, configured to use a pitch that enables the auto correlation function to be the largest or the energy of the LTP residual signal to be the smallest within the candidate pitch range as the selected pitch.

* * * * *